US007073307B2

(12) United States Patent
Matumoto et al.

(10) Patent No.: US 7,073,307 B2
(45) Date of Patent: Jul. 11, 2006

(54) HEAT SHIELDING MEMBER OF HOUSING

(75) Inventors: Setuya Matumoto, Sapporo (JP); Keiji Matumoto, Sapporo (JP)

(73) Assignee: Matumotokenkou Kabushiki Kaisha, Sapporo (JP)

( * ) Notice: Subject to any disclaimer, the term of this patent is extended or adjusted under 35 U.S.C. 154(b) by 481 days.

(21) Appl. No.: 10/685,773

(22) Filed: Oct. 14, 2003

(65) Prior Publication Data

US 2004/0237415 A1 Dec. 2, 2004

(30) Foreign Application Priority Data

May 29, 2003 (JP) ..... 2003-152469

(51) Int. Cl.
*E04C 2/32* (2006.01)

(52) U.S. Cl. ..... 52/783.11; 52/95; 52/302.1; 52/302.3; 52/783.17

(58) Field of Classification Search ..... 52/792.1, 52/95, 302.1, 302.3, 199, 783.17; 428/251, 428/268, 229, 138

See application file for complete search history.

(56) References Cited

U.S. PATENT DOCUMENTS 3,884,009 A * 5/1975 Frohlich et al. ..... 52/745.06
4,691,482 A * 9/1987 Heinemann et al. ..... 52/3
5,596,847 A * 1/1997 Stephenson ..... 52/198

OTHER PUBLICATIONS

"Heat Shielding Member of Housing", Setuya Matumoto et al., Serial No. Unknown, Filed Oct. 14, 2003.

* cited by examiner

*Primary Examiner*—Naoko Slack
*Assistant Examiner*—Tiara Robertson
(74) *Attorney, Agent, or Firm*—Flynn, Thiel, Boutell & Tanis, P.C.

(57) ABSTRACT

There is provided a heat shielding member for a thermal insulation structure which does not form a heat accumulator even if it receives a heating load from the outside and which is easily fixed and installed from the indoor side when it is applied to the thermal insulation structure between timbers such as rafters, vertical frames of a wall and the like of a house. The heat shielding member is structured such that spaces of the air layer are formed between an upper layer, an intermediate layer, and a lower layer, a radiant heat reflective layer Re is provided on upper faces of respective layers, and the upper layer is formed of a shape-retention upper sheet to which a cover sheet is laminated, wherein bent-up legs having restorability are disposed on both sides of the shape-retention upper sheet through the intermediary of bent-up parts, and the heat shielding member is engaged and mounted between timbers such as rafters having an interval therebetween, and it is held in a proper posture when the bent-up legs are stretched against and held by faces of the timbers, so that the interval is closed by the cover sheet, thereby restraining radiant heat from transferring downward from the upper layer, and blocking heat permeated the upper layer by the intermediate layer and the lower layer, discharging heat through spaces, and restraining the heat from transferring from the outdoor side toward the indoor side without accumulating heat.

10 Claims, 8 Drawing Sheets

FIG. 7(A) (First Prior Art)
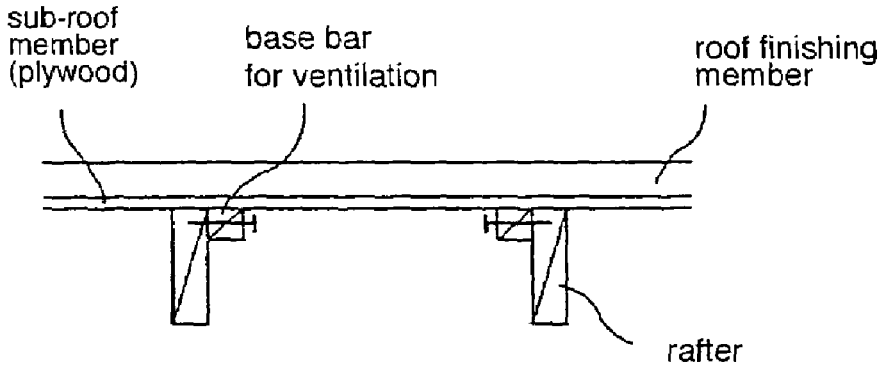
FIG. 7(B) (First Prior Art)
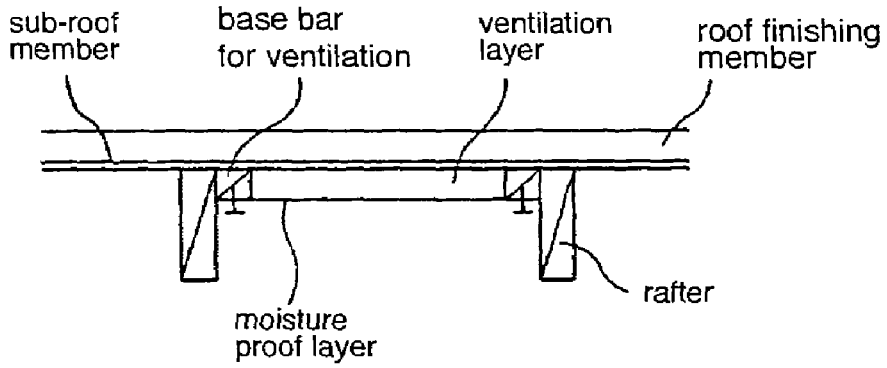
FIG. 7(C) (First Prior Art)
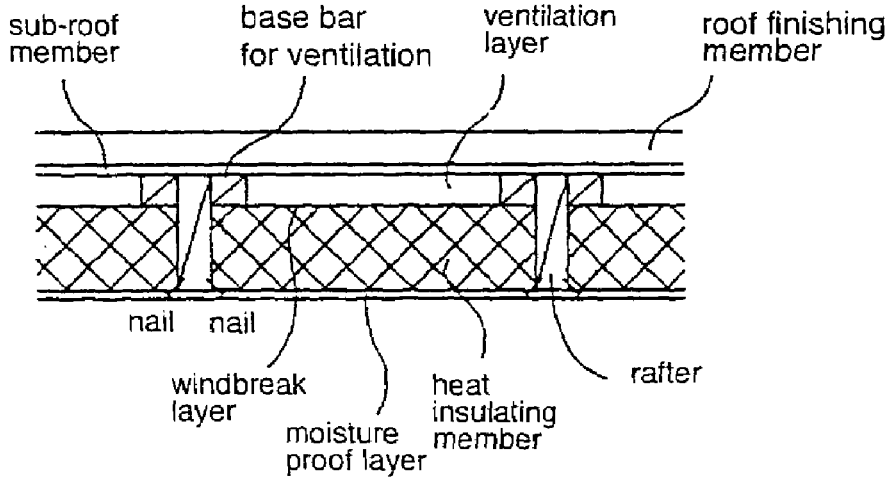

FIG. 8(A) (Second Prior Art)
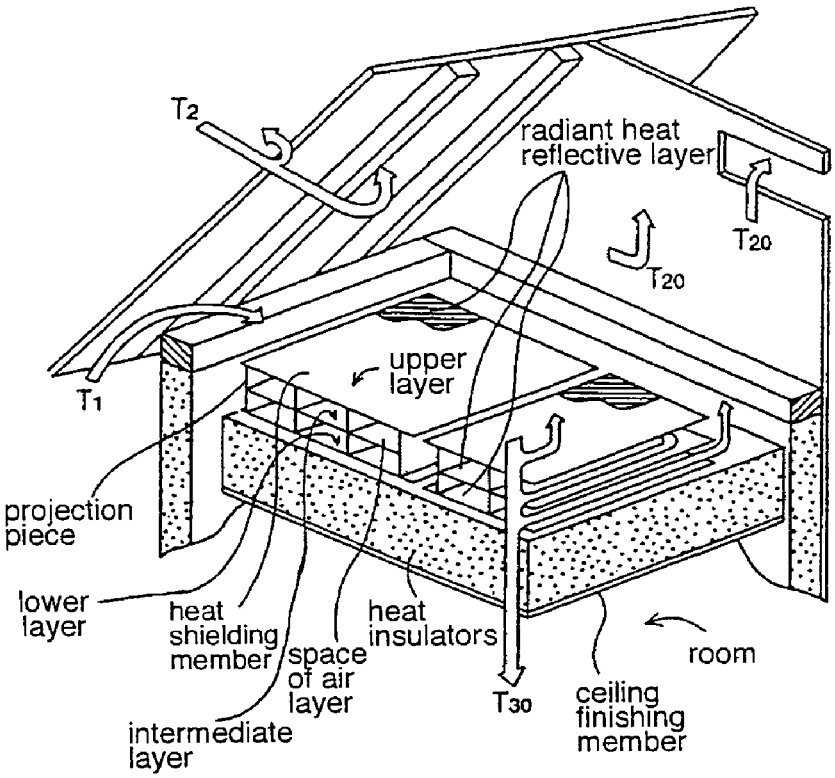
FIG. 8(B) (Second Prior Art)
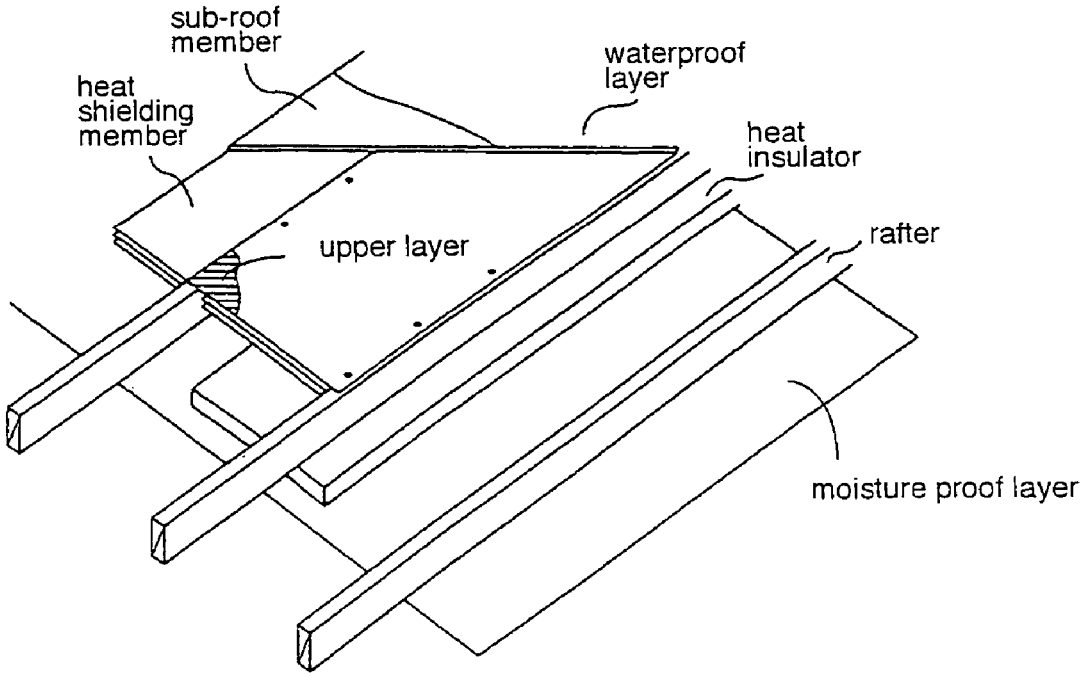

HEAT SHIELDING MEMBER OF HOUSING

FIELD OF THE INVENTION

The invention is intended to provide improvement on a thermal insulation structure of a house, and is related to a heat shielding member for shielding and restraining heat transfer between an outside and an indoor of the house, and belongs to a technical field of a housing construction.

BACKGROUND OF THE INVENTION

The technique as disclosed in a Non-Patent Reference is shown in FIGS. 7(A)–7(C), namely, in Item (6) of "thermal insulation of a roof" pp 192–193, extracted from a literature entitled "Explanation of Standard of Energy-Saving of Housing" published Jun. 1, 2002 by Foundation for Building Environment Energy Saving Organization, and it is a typical example of a thermal insulation of a roof of housing.

That is, rafters are fixed to a ridge pole, a purlin, a top plate and the like of a roof truss by nails, and a sub-roof member such as plywood and the like are fixed to the rafters by nails, then (Amend 1) base bars for ventilation are fixed to the upper side surfaces of the rafters by nails as shown in FIG. 7(A), thereafter moisture-permeable waterproof sheet or a windbreak layer such as plywood and the like are fastened on the base bars for ventilation as shown in FIG. 7(B), thereby forming a ventilation layer between the sub-roof member and the windbreak layer.

Subsequently, as shown in FIG. 7(C), the heat insulators, which are cut to have a length corresponding to the interval between the rafters, are engaged between the rafters from an indoor side and fixed to the same by nails so as not to slide down, then the moisture-proof layer made of vinyl chloride or the like is fixed to the rafters by a tacker or the like from the lower side of the heat insulators.

FIGS. 8(A) and 8(B) shows a heat shielding member as disclosed in Patent Reference which has been filed by the same applicant under Ser. No. 271,335, and laid open to public inspection Dec. 26, 2000 under No. 2000-355,989 and patented under U.S. Pat. No. 3,251,000.

That is, as shown in FIGS. 8(A) and 8(B), the heat shielding member comprises an upper layer, an intermediate layer, a lower layer which have radiant heat reflective layers Re on upper faces thereof, and coupled with one another by a group of stand-up pieces which are freely laid down, wherein the respective spaces of an air layer are formed between respective layers for air ventilation. When the interior of an attic is subjected to thermal insulation, the heat shielding member is placed on a heat insulator disposed on a ceiling finishing member, as shown in FIG. 8(A), and the end edges of the upper layer of the heat shielding member are fixed to a structure member and the like, thereby keeping a stand-up state of the heat shielding member.

Further, when the roof is subjected to thermal insulation, as shown in FIG. 8(B), the heat shielding member is engaged between the rafters from the above and both sides of the upper layer are fixed to the upper surfaces of the rafters by a tacker or the like, then the heat insulator is brought into contact with the lower face of the heat shielding member and fixed to the same by nails and the like, thereafter a moisture-proof layer provided on the lower face of the heat insulator is fixed to the rafters by a tacker and the like, subsequently, a sub-roof member is disposed on the upper face of the heat shielding member and nailed and fixed to the rafters, and finally a waterproof layer and a roof finishing member are extended on the sub-roof member.

According to the first prior art shown in FIGS. 7(A)–7(C), although a ventilation layer, which is effective for discharging heat caused by high temperature heating from a roof surface, is formed, and an insulator having a desired thickness can be provided by selecting the height of the rafters, the heat insulator becomes an accumulation body having a large capacity owing to the heating from the roof, and hence even if the outside air temperature is lowered at night, the heat insulator continues to discharge heat, which deteriorates the indoor environment, requiring a long run of an air conditioner for cooling.

Further, according to the second prior art as shown in FIGS. 8(A) and 8(B) which is an improvement of the thermal insulation structure of the first prior art, although the amount of heat accumulation in the heat insulator can be significantly restrained because the heat insulator is covered with the heat shielding member, the heat shielding member lacks in independence, and hence fixing and installation of the upper layer of the heat shielding member to the peripheral structure member are needed for holding the heat shielding member at a predetermined position. Accordingly, when the heat shielding member is applied to the thermal insulation of the roof as shown in FIG. 8(B), after the heat shielding member is fixed to the rafters, the sub-roof member needs to be extended on the heat shielding member, and when providing the heat shielding member, the installation from the indoor side is impossible and requires a complex, difficult and dangerous operation at high place from the top of the roof.

Still further, since the operation of providing the heat shielding member precedes the operation of extending the sub-roof member and the waterproof layer, this can not be effected in a rainy weather. If the heat shielding member gets wet during the provision thereof, causing a problem of mold growth and rot during the service life of a house.

SUMMARY OF THE INVENTION

The invention has been developed to improve or solve the problems of the first and second prior arts and to provide a heat shielding member capable of restraining heat accumulation in a heat insulator and of easily being provided and installed.

The present invention relates to a heat shielding member of a house, for example, as shown in FIG. 1, comprising a plurality of layers 1A, 1B, 1C comprised of an upper layer 1A including at least a shape-retention upper sheet 12 to an upper face of which a cover sheet 11 is laminated and a lower layer 1C made up of a lower sheet 15, spaces S1, S2 of an air layer formed between respective layers which are coupled by a group of stand-up pieces 16, 17 at both ends thereof and having an opening enabling ventilation in the longitudinal direction, radiant heat reflective layers Re provided on respective upper faces of the layers 1A, 1B, 1C, and the shape-retention upper sheet 12 having bent-up legs 12L, 12R at both sides and having restorability at bent-up parts 12S.

Meanwhile, the multiple layers may be two layers formed of the upper layer 1A and the lower layer 1C or may be triple-layers formed of the upper layer 1A, the intermediate layer 1B, and the lower layer 1C or not less than four layers including multiple intermediate layers.

Further, the spaces S1, S2 of the air layer formed between the respective layers 1A, 1B, 1C may be sufficient if a natural convection of air is generated therein and they may be provided with an interval Sh of layer in the range of 10 to 20 mm.

Still further, the shape-retention upper sheet 12 may be sufficient to be a sheet capable of maintaining flatness of the upper layer 1A during the service life thereof, and the bent-up legs 12L, 12R disposed at both sides thereof by way of the bent-up parts 12S are sufficient to have a strength and restorability for preventing the heat shielding member 1 from being deformed and laid down when it is brought into contact with side members thereof, and hence the shape-retention upper sheet 12 may be made up of plastic sheet or thick kraft paper and the like, typically represented by corrugated paper having 3 mm thickness.

Further, the cover sheet 11 gives a radiant heat reflection function to the upper layer 1A and covers the upper layer 1A so as not to produce a gap between the upper layer 1A and the timbers such as rafters 3 and the like, and it is typically made up of kraft paper same as the lower sheet 15.

Further, the lower sheet 15, and a sheet for the intermediate layer which is disposed, if necessary, and the stand-up pieces 16, 17 and the like can be structured by a sheet member capable of keeping a flat shape during the service life thereof, typically represented by kraft paper.

Further, the radiant heat reflective layer Re is preferably made up of a metalized film or a metal foil which is excellent in heat reflection, and typically made up of an aluminium foil stuck layer.

Still further, the bent-up legs 12L, 12R may be brought into contact with the timbers and the like disposed at the sides thereof to stretch and support the timbers and the like for preventing the heat shielding member 1 from being deformed and laid down during the service life thereof, and the length of the bent-up legs 12L, 12R may be selected, if necessary.

Further, "restorability" means property to return from a bent-up state to a flat state, and if the bent-up legs 12L, 12R have the restorability, they exert a restoring force F0 about the bent-up parts 12S serving as reference points as shown in FIGS. 4(A) and 4(B).

Further, the width of the lower sheet 15 may include the width of the extension parts 15L, 15R if they are provided as shown in FIG. 1, or may be the same as the width W2 between the bent-up parts 12S of the upper layer 1A as shown in FIGS. 5(A) and 5(B).

Accordingly, since the bent-up legs 12L, 12R which are disposed at both sides of the shape-retention upper sheet 12 by way of the bent-up parts 12S has a shape retention strength and restorability, in cases where the heat shielding member 1 is engaged between and applied to the rafters 3, for example, as shown in FIG. 4(A), the bent-up legs 12L, 12R having shape retention strength are brought into contact with the side faces 3F of the rafters 3 serving as structural members at both side thereof in a stretched state owing to the restoring force F0 about the bent-up parts 12S serving as reference points, so that the bent-up legs 12L, 12R prevent the heat shielding member 1 from being deformed or laid down, thereby completely assuring the radiant heat reflecting operation on the upper layer 1A, the intermediate layer 1B, and the lower layer 1C, and the air ventilation in the spaces S1, S2 of the air layer between respective layers.

Then, a heat applied to the heat shielding member 1 from the sub-roof member 4 and the sub-wall member 40 which are rendered high in temperature by heating from the outdoor side is prevented from being transferred to the interior of the heat shielding member 1 owing to the radiant heat reflection operation on the cover sheet 11 on the upper layer 1A, while a small amount of heat transferred from the upper layer 1A to the interior of the heat shielding member 1 is discharged by gentle air current from the spaces S0, S1, S2 of the air layer owing to the radiant heat reflection operation on the intermediate layer 1B and/or lower layer 1C, thereby preventing the heat from the upper (exterior) portion of the upper layer 1A from being transferred to the lower (interior) portion of the lower layer 1C.

Accordingly, the heat shielding member 1 which is applied as shown in FIG. 4(A) provides a heat insulating structure having no heat accumulation function.

Further, the provision of the radiant heat reflective layer Re on the upper layer 1A leads to the provision of the radiant heat reflective layer Re on the cover sheet 11, which can be realized by merely laminating a plastic film to which an aluminium foil layer is stuck, to a face of flexible kraft paper which is excellent in adhesiveness, and hence it is possible to select a material of the shape-retention upper sheet 12 on which the radiant heat reflective layer Re is difficult to be provided, thereby increasing a freedom of selection of material to rationalize the fabrication of the heat shielding member 1.

Further, when the heat shielding member 1 is superimposed on the upper face (outside face) of the heat insulator 2 as shown in FIG. 4(B) or FIGS. 5(A) and 5(B), the heat shielding member 1 significantly mitigates the heating load applied to the heat insulator 2 from the outdoor side, and since the heat insulator 2 is thermally protected by the heat shielding member 1, the amount of heat accumulation in the heat insulator 2 can be significantly reduced as well as the thickness of the heat insulator 2 being rendered thin.

Further, it is desirable that the heat shielding member 1 is structured such that the cover sheet 11 has left and right extension parts 11L, 11R extended from the upper face of the bent-up parts 12S of the shape-retention upper sheet 12 toward both sides thereof.

In this case, since the shape-retention upper sheet 12 forms the bent-up legs 12L, 12R at the bent-up parts 12S, the lamination of the cover sheet 11 to the shape-retention upper sheet 12 is performed on the flat surface of the upper layer 1A by the width W1 while the left and right extension parts 11L, 11R can be deformed owing to flexibility of the cover sheet 11 per se from the bent-up parts 12S.

Accordingly, each length of the left and right extension parts 11L, 11R is larger than the interval between the side faces 3F and the bent-up parts 12S as shown in FIGS. 4(A) and 4(B), the left and right extension parts 11L, 11R are inclined and bent owing to the flexibility and brought into contact with the side faces 3F while if each length of the left and right extension parts 11L, 11R is substantially equal to the interval between the side faces 3F and the bent-up parts 12S as shown in FIG. 5(B), the left and right extension parts 11L, 11R are brought into contact with the side faces 3F without being bent.

The cover sheet 11 having the radiant heat reflective layer Re on the face thereof closes the entire interval L3 between the rafters 3 irrespective of the state of the cover sheet 11, namely, in a bent state shown in FIG. 4(A) or in a linear state shown in FIG. 5(B), thereby restraining air inside the space S0 of the air layer which is rendered high in temperature from flowing downward, and preventing heat in the space S0 of the air layer from transferring to the interior of the heat shielding member 1 as radiant heat.

The length of extension of the left and right extension parts 11L, 11R may be sufficient to be set at the same as or larger than the dimensions between the bent-up parts 12S and the side faces 3F of the timbers (rafters) because the left and right extension parts 11L, 11R can be freely bent on the bent-up parts 12S, and a high temperature air flows toward side portions of the heat shielding member 1 (downward from the cover sheet 11) when a spacing is produced between the left and right extension parts 11L, 11R and the side faces 3F. Further, the length of extension of the left extension part 11L may be sufficient not to be the same as that of the right extension part 11R.

It is desirable that the heat shielding member 1 is structured such that the multiple layer is made up of triple-layers having a single intermediate layer 1B formed of the intermediate sheet 14.

Meanwhile, provided that the layer interval Sh between the respective layers 1A, 1B, 1C is not less than 10 mm, smooth convection of air in the spaces S1, S2 of the air layer can be obtained, and hence the layer interval Sh inside the space S1 of the air layer and that inside space S2 of the air layer may not be always the same in dimensions.

In this case, the spaces S1, S2 of the air layer of double layer is formed inside the heat shielding member 1 owing to the presence of one intermediate sheet 14 while keeping a height of the layer interval Sh necessary for a natural convection of air, and restraining the height h1 of the heat shielding member 1.

Accordingly, the heat shielding member 1 becomes high performance member capable of discharging heat which permeated downward from the cover sheet 11 and transferred to the interior of the heat shielding member 1 can be discharged by two stages of the radiant heat reflective layer Re through the intermediary of the space S1, S2 of the air layer, the heat shielding member 1 can be structured relatively low in height h1, and hence a degree of freedom of the application to the thermal insulation of the house increases.

Further, since the intervened intermediate sheet 14 is advantageous in fulfilling not only a heat shielding function, but also a function to reinforce of the stand-up pieces 16, 17, the high performance heat shielding member 1 having the low height h1 can be fabricated by thin and easily bendable paper material (kraft paper), and hence workability of fabrication is improved.

Further, it is desirable that the heat shielding member 1 is structured such that the upper layer 1A is made up of the upper sheet 13, the shape-retention upper sheet 12 laminated to the upper sheet 13, and the cover sheet 11 laminated to the shape-retention upper sheet 12, and the group of stand-up pieces 16, 17 are coupled and fixed to the lower sheet 15 and the upper sheet 13 to be freely laid down.

Meanwhile, since the upper sheet 13 may be sufficient to fix and hold the group of the stand-up pieces 16, 17 by an adhesive and the like and it is fixed to the lower face of the shape-retention upper sheet 12 by an adhesive and the like, the width 13W (W2) of the upper sheet 13 may be sufficient to have any dimension by which the stand-up pieces 16 can be fixed to the upper sheet 13 at both sides and which does not interfere with the bending of the bent-up legs 12L, 12R.

In this case, since a heat shielding member body 10 formed by coupling the thin upper sheet 13 and the lower sheet 15 by the group of stand-up pieces 16, 17 which are freely laid down is prepared in advance as shown in FIG. 2, and a cover body (cover layer) 10' to which the thick shape-retention upper sheet 12 having a strength and the restorability is laminated, wherein the thin cover sheet 11 is bonded to the shape-retention upper sheet 12, is bonded to the upper sheet 13 of the heat shielding member body 10 to cover thereof, if necessary, thereby fabricating the heat shielding member 1, and also the desired intermediate sheet 14 can be disposed between the stand-up pieces 16, 17 by bonding the bent-up pieces 14' to the stand-up pieces 16, 17, and when the heat shielding member body 10 is stored, the stand-up pieces 16, 17 are laid down to be in a stacked form, as shown in FIGS. 2, 3(A) and 3(B) when preparing the heat shielding member body 10, the fabrication and storage of the heat shielding member 1 can be made easy.

Further, it is desirable that the heat shielding member 1 is structured such that end edges 13E of the upper sheet 13 define the bent-up parts 12S of the bent-up legs 12L, 12R of the shape-retention upper sheet 12.

In this case, since the flat face width W1 between the bent-up parts 12S at both sides of the shape-retention upper sheet 12 is reinforced by the lamination of the upper sheet 13 and the creases can be easily put to the bent-up parts 12S, a degree of freedom of the selection of a material of the shape-retention upper sheet 12 increases.

Further, provided that the width of the lower sheet 15 is the same as the width W2 of the width of the upper sheet 13, as shown in FIGS. 5(A) and 5(B), the width of the heat shielding member 1 becomes the width obtained by the width W1 of the upper sheet 13 plus inclined protrusion widths W0 of the bent-up legs 12L, 12R when the bent-up legs 12L, 12R are inclined sideward, and the inclined protrusion width W0 is determined by the manner of use of the heat shielding member 1, and hence the heat shielding member 1 can be engaged in the rafters 3 having interval dimensions which are the same width as or greater than the flat face width W1 as shown in FIGS. 5(A) and 5(B), so that the heat shielding member 1 is advantageous in that the heat insulator 2 is bonded to the bottom face 15B of the lower sheet 15, and also advantageous in that multiple heat shielding members 1 are placed on the heat insulator 2 inside an attic and the like in parallel with one another.

It is desirable that the heat shielding member 1 is structured such that the upper layer 1A is made up of the shape-retention upper sheet 12 and the cover sheet 11, and the group of the stand-up pieces 16, 17 are fixed between the lower sheet 15 and the shape-retention upper sheet 12 to be freely laid down.

In this case, if a material of the shape-retention upper sheet 12 is properly selected from the aspect of adhesiveness and shape retention strength, it is possible to fabricate the shape-retention upper sheet 12 having necessary bending strength and restorability and the thin lower sheet 15 by bonding therebetween through the intermediary of the thin stand-up pieces 16, 17, wherein since the upper sheet 13 is omitted, the structure of the heat shielding member 1 is simplified to reduce the fabricating cost of the heat shielding member 1.

Further, it is desirable that the heat shielding member 1 is structured such that the lower sheet 15 has extension parts 15L, 15R at both sides thereof.

In this case, the extension parts 15L, 15R have a function not only to form the thermal insulation structure which does not accumulate heat by the heat shielding member 1 alone without using the heat insulator 2 when it is utilized to be fixed to the structure member such as the rafters 3 and the like as shown in FIG. 4(A), but also to fill up and mount the fibrous insulator such as glass wool and the like and a solid insulator such as foam plastics and the like on the bottom face 15B of the lower sheet 15 by pushing the heat shielding member 1 between the rafters 3 while bending the extension parts 15L, 15R, which are in turn fixed to the side faces 3F by staples N and the like when the heat insulator 2 is disposed on the bottom face 15B of the lower sheet 15 as shown in FIG. 4(B).

It is needless to say that after the solid heat insulator 2 such as foam plastics and the like is integrated with the bottom of the lower sheet, the heat insulator 2 is pushed between the rafters 3, thereby engaging the heat shielding member 1 between the rafters 3.

Accordingly, the range of utilization is widened. Further, it is desirable that the heat shielding member 1 is structured such that the shape-retention upper sheet 12 defines the flat face width W1 of the upper layer 1A between the bent-up parts 12S, and has the bent-up legs 12L, 12R having the dimensions which are substantially the same as the height h1 between the bent-up parts 12S and the lower sheet 15.

In this case, the bent-up legs 12L, 12R perform the function of the reinforcing members of the stand-up pieces 16, 17 when the heat shielding member 1 is engaged and pressed between the structure member to render the pressing operation easy, so that the deformation of the heat shielding member 1 caused by the deformation of the stand-up pieces 16, 17 is restrained to the minimum, so that the heat shielding member 1 is easily fixed and installed.

According to the heat shielding member 1 of the invention, it is desirable that both the outer faces 16F of the stand-up pieces 16 at both ends of the heat shielding member 1 and the lower face of the lower sheet 15 has the radiant heat reflective layers Re, and the pin holes ho for moisture permeability are dispersedly disposed on the entire faces of the intermediate sheet 14 and the lower sheet 15 constituting the intermediate layer 1B.

In this case, each of the pin holes ho is formed by subjecting a sheet member provided with the radiant heat reflective layer Re made up of the aluminium foil and the like to a needling process.

Owing to the existence of the pin holes ho for moisture permeability, both the spaces S1, S2 of the air layer inside the heat shielding member 1 are rendered to be moisture permeable while communicating with each other, dew condensation and mold growth can be restrained in the heat shielding member 1, thereby restraining contamination of the radiant heat reflective layer Re during the service life thereof to improve the durability of the reflection function. Further, when the heat shielding member 1 is integrally used with the heat insulator 2 in a stacked form, it is possible to prevent the thermal insulation function from lowering owing to the moisture absorption by the heat insulator 2.

Further, owing to the radiant heat reflective layers Re on the outer faces 16F of the stand-up pieces 16 at both ends, the radiant heat which permeated a space S4 of the air layer positioned thereunder through left and right extension parts 11L, 11R and transferred to an interior of the space S3 of the air layer formed between the bent-up legs 12L, 12R and the stand-up pieces 16 can be suitably discharged by the ventilation inside the space S3.

Still further, the radiant heat reflective layer Re on the bottom face 15B of the lower sheet 15 can restrain the loss of the indoor heat to the outside when the indoor temperature is higher than the outdoor temperature in a winter season and the like, which is advantageous for reducing indoor heating energy.

Further, it is desirable that the heat shielding member 1 is structured such that the shape-retention upper sheet 12 is made up of corrugated paper and the other sheets 13, 14, 15 and the stand-up pieces 16, 17 are made up of kraft paper, and also the radiant heat reflective layer Re is made up of an aluminum foil stuck layer.

In this case, the corrugated paper has a thickness of about 3 mm and typically made up of a corrugating medium covered with front and back kraft paper laminated thereto.

Since respective constituent sheet members of the heat shielding member 1 are made up of kraft paper, respective constituent sheet members can be well bonded to one another so that the heat shielding member 1 made of paper can be easily fabricated by bonding thereof.

Further, the aluminium foil stuck layer has a smooth reflection face and is capable of providing the radiant heat reflective layer Re of high performance with low cost.

Accordingly, it is possible to provide a general-purpose high performance heat shielding member 1 made up of an easily available material with low cost.

BRIEF DESCRIPTION OF THE DRAWINGS

FIGS. 3(A) and 3(B) are front views for explaining the heat shielding member of the first embodiment of the invention, wherein FIG. 3(A) is a view showing a state where the heat shielding member is raised up from a stacked form, FIG. 3(B) shows a stand-up state of the stand-up pieces;

FIGS. 4(A) and 4(B) are views for explaining the use of the heat shielding member of the first embodiment of the invention, wherein FIG. 4(A) is a front view showing the fixing of the heat shielding member alone, and FIG. 4(B) is a front view showing the use of the heat shielding member integrally with the heat insulator;

FIGS. 5(A) and 5(B) are views for explaining the use of a heat shielding member according to a second embodiment of the invention, wherein FIG. 5(A) is a view showing a pressed-in state and FIG. 5(B) is a view showing a fixing completion state;

FIGS. 6(A) and 6(B) are front views for explaining a heat shielding member according to a third embodiment of the invention, wherein FIG. 6(A) shows a thermal insulation structure formed by the heat shielding member alone, and FIG. 6(B) shows a state where the heat insulator is provided on the heat shielding member;

FIGS. 7(A)–7(C) are front views for explaining a first prior art arrangement, wherein FIG. 7(A) shows a state of fixing base bars for ventilation, FIG. 7(B) shows a state of forming a ventilation layer, and FIG. 7(C) shows a state of forming a thermal insulation structure; and FIGS. 8(A) and 8(B) are perspective views for explaining a second prior art arrangement, wherein FIG. 8(A) shows a thermal insulation structure on a ceiling finishing member, and FIG. 8(B) is a view showing a thermal insulation of a roof.

PREFERRED EMBODIMENT OF THE INVENTION

Fabrication of a heat shielding member:

First Embodiment

Figure 1:
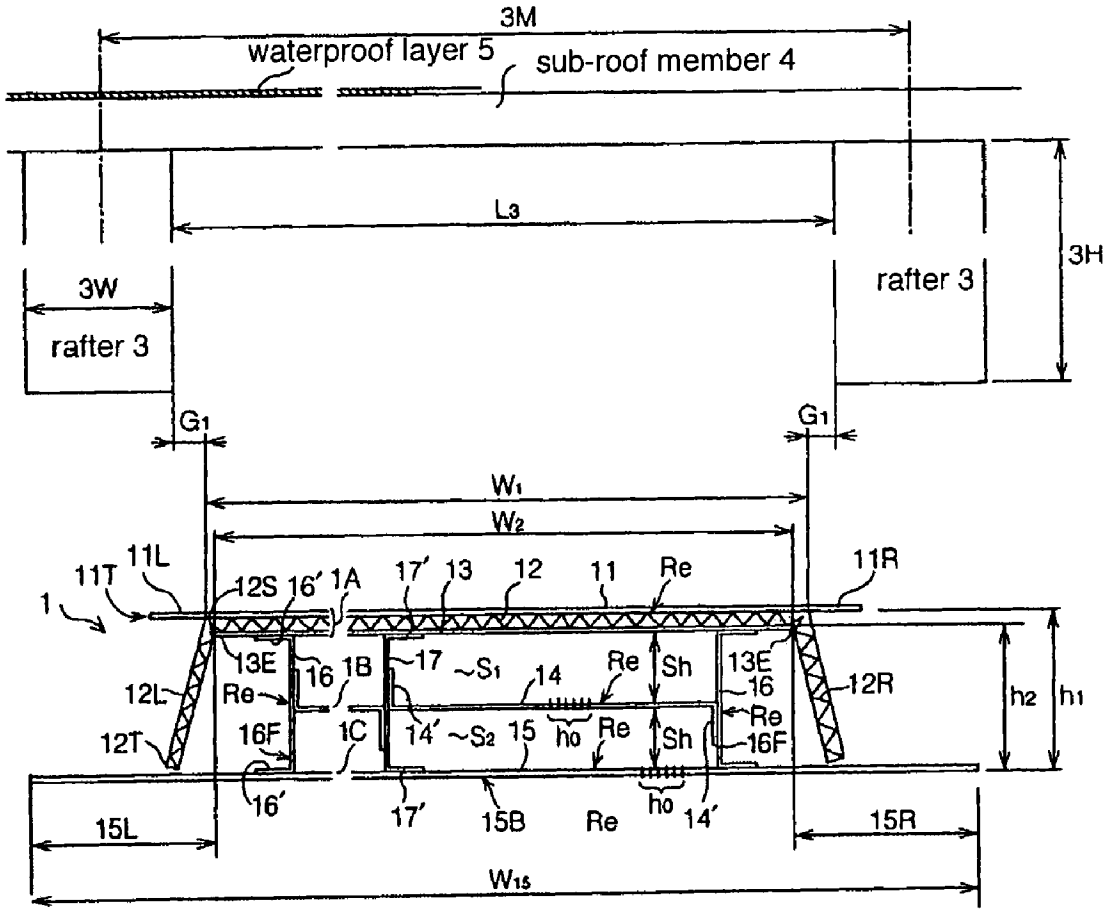
FIG. 1 is a front view of a heat shielding member according to a first embodiment of the invention.

A Lower Sheet 15 is a Type Having Extension Parts 15L, 15R [FIG. 1]

Figure 2:
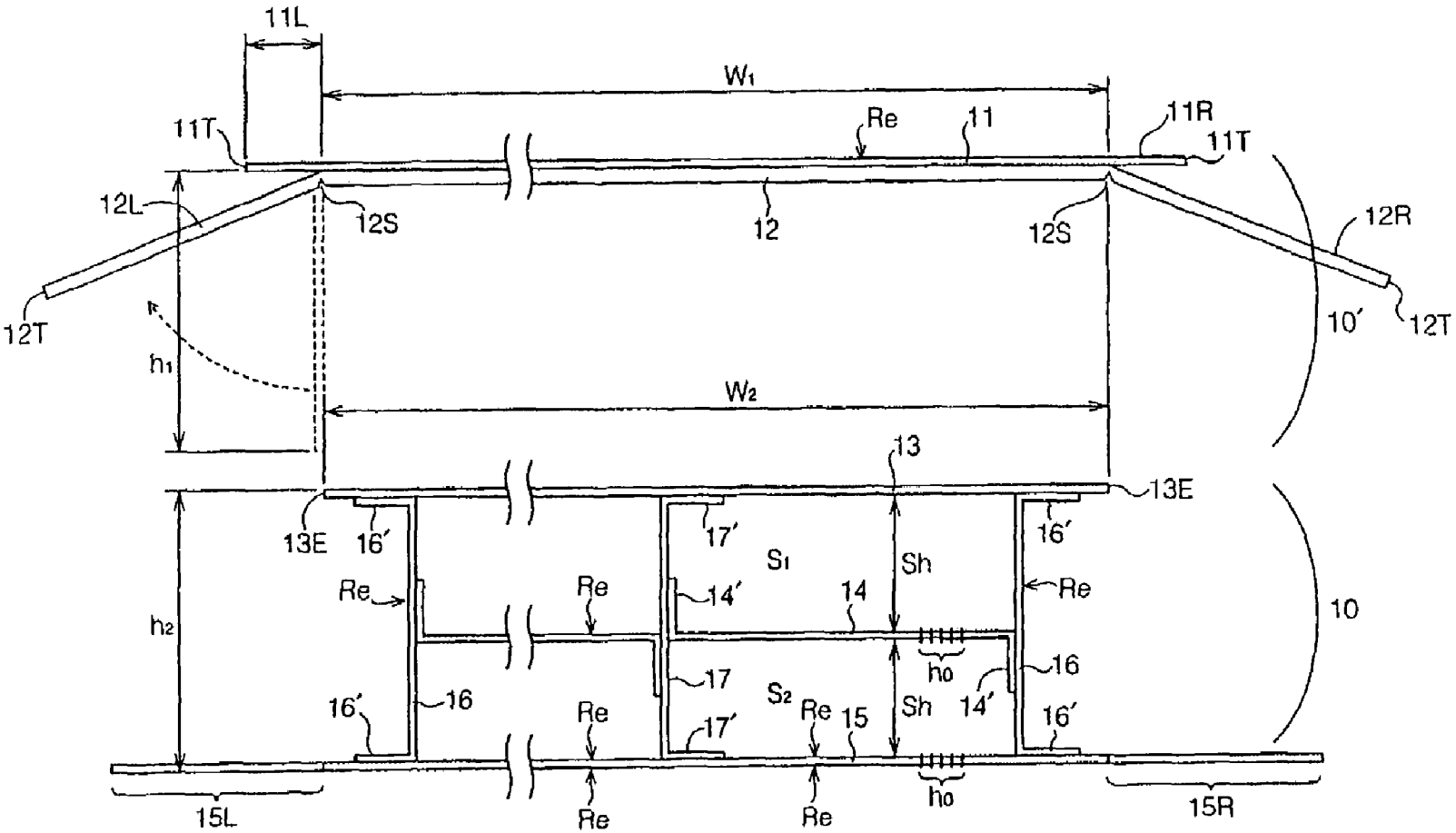
FIG. 2 is a partially exploded view for explaining the heat shielding member of the first embodiment.
Figure 3A:
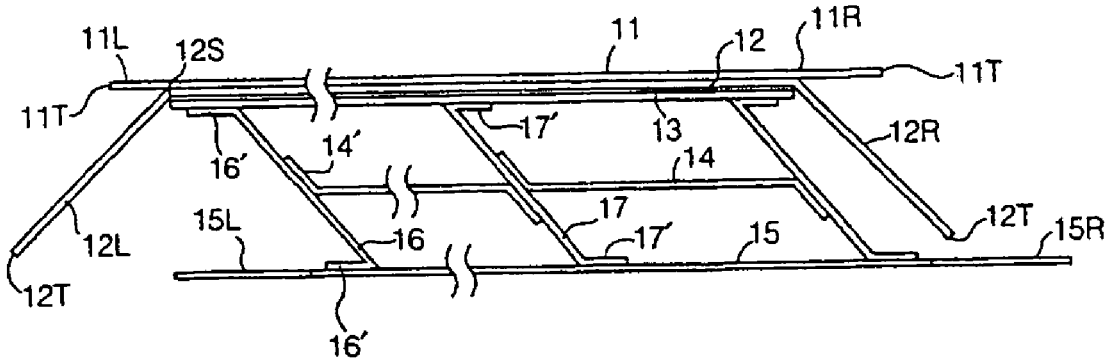
Figure 3B:
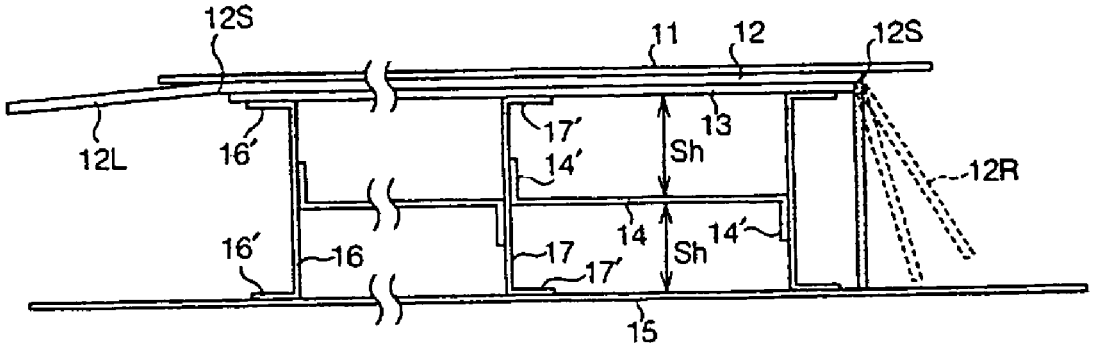

FIG. 2 is a partially exploded view for explaining a heat shielding member 1 having three stacked layers in FIG. 1, and the heat shielding member 1 shown in FIG. 1 comprises an upper sheet 13, an intermediate sheet 14 and a lower sheet 15 and forms a heat shielding member body 10 having triple-layer configuration wherein the lower sheet 15 has extension parts 15L, 15R at both sides thereof, and a cover layer (cover body) 10' formed by a cover sheet 11 laminated to and integrated with a shape retention upper sheet 12 is placed on the upper face of the upper sheet 13 of the heat shielding member body 10.

There are provided stand-up pieces 16, 17 wherein the stand-up pieces 16 are positioned at both ends of the stand-up pieces 16, 17 (hereinafter referred to as end stand-up pieces 16 and the stand-up piece 17 is positioned between both the stand-up pieces 16 (hereinafter referred to as intermediate stand-up piece 17).

The constituent sheet members of the heat shielding member body 10 made up of paper such that the intermediate stand-up pieces 17 and the upper sheet 13 are made up of kraft paper of 165 g/m$^2$ and the lower sheet 15 is made up of kraft paper of 165 g/m$^2$ and a polyethylene film provided with an aluminum foil of 6.3 μm which is laminated to both front and back faces of the kraft paper which is perforated on the entire face to form pin holes ho by a needling process, and the intermediate sheet 14 is made up of kraft paper of 70.8 g/m$^2$ and a polyethylene film provided with an aluminum foil of 6.3 μm which is laminated to one face of the kraft paper which is perforated on the entire face to form pin holes ho by a needling process.

Further, both the end stand-up pieces 16 are made up of kraft paper of 165 g/m$^2$ and a polyethylene film provided with an aluminum foil of 6.3 μm which is laminated to one face of the kraft paper.

Then, as shown in FIG. 2, the stand-up pieces 16, 17 are bonded to the upper sheet 13 and the lower sheet 15 by bent pieces 16', 17' (standard width: 10 mm) formed at both ends thereof and the intermediate sheet 14 is bonded to the stand-up pieces 16, 17 by the bent pieces 14', 14' (standard width: 10 mm) formed at both sides thereof, thereby forming spaces S1, S2 of an air layer which penetrate between respective sheets in the longitudinal direction by the stand-up pieces 16, 17 with an effective height of h2 (standard width: 35 mm).

The cover body (cover layer) 10' is made up of corrugated paper (front and back paper: 180 g/m$^2$; corrugating medium: 120 g/m$^2$) wherein the wavelike ridges of the corrugating medium are directed in the width direction and the cover sheet 11 is laminated to the front face of the corrugated paper. The cover sheet 11 is made up of kraft paper of 165 g/m$^2$ and a polyethylene film provided with an aluminum foil of 6.3 μm which is laminated to the front face of the kraft paper.

The cover sheet 11 is bonded to the shape-retention upper sheet 12 by the width W1 between the bent-up parts 12S provided at both sides of the shape-retention upper sheet 12, and the left and right extension parts 11L, 11R (standard: 15 mm) are not bonded to the bent-up legs 12L, 12R.

The heat shielding member 1 is fabricated to have a long sheet in lengthwise dimension (perpendicular direction to the paper showing FIG. 2) and it is cut at an appropriate length corresponding to an applied position when used.

Further, a widthwise dimension of the heat shielding member 1 is determined corresponding to the applied position. For the heat shielding member 1 for use in thermal insulation of a roof, as shown in FIG. 1, provided that the width 3W of the rafters 3 is 38 mm, the height 3H of the rafters 3 is 89 mm, and the interval dimension 3M between the cores of the rafters 3 is 500 mm, an interval L3 between the rafters 3 at both sides of the heat shielding member 1 becomes 462 mm while the flat face width W1 of the upper layer 1A of the heat shielding member 1 is set at 425 mm, and the width W2 of the upper sheet 13 is set at about 420 mm so that the end edges 13E assure even the bending of the bent-up parts 12S of the shape-retention upper sheet 12 at right angles, and the width W15 of the lower sheet 15 is set at the width including the entire width of the bottom faces of the rafters 3, namely, the width W1 plus the entire widths of the bottom face 3B so as to set a spacing G1 between both sides of the flat face of the upper layer 1A and the side faces 3F of the rafters at about 7.5 mm.

The heat shielding member body 10 is structured, as shown in FIG. 2, such that both the end stand-up pieces 16 and the intermediate stand-up piece 17 are bonded and fixed to the upper sheet 13 and the lower sheet 15 by providing an adhesive to bent pieces 16', 17' provided at upper and lower ends thereof and having the width of 10 mm while keeping the effective height h2 of the heat shielding member body 10 (standard: 35 mm), and the intermediate sheet 14 are bonded to and integrated with the stand-up pieces 16, 17 by providing an adhesive to the bent pieces 14' provided at both ends thereof and having the width of 10 mm. In the case where the respective sheet members (kraft paper) are formed of long sheets, the heat shielding member body 10 is fabricated in a stacked form through a flow process comprising the steps of bending→providing an adhesive→press-bonding by the group of rolls (not shown).

It is needless to say that the fabrication of the heat shielding member body 10 may be carried out by hand.

Thereafter, the cover body (cover layer) 10' made up of thick corrugated paper to which the cover sheet 11 is laminated is placed on the upper sheet 13 of the heat shielding member body 10 made up of thin kraft paper while the wavelike ridges of the corrugating medium are directed in the width direction, then the flat face of the shape-retention upper sheet 12 between the bent-up parts 12S is bonded to the entire face of the upper sheet 13.

In this case, the shape-retention upper sheet 12 of the cover body has the bent-up legs 12L, 12R at the both sides in the width direction of the width W1 on the flat face and the bent-up legs 12L, 12R have lengths equal to the length of a height h1 (standard: 38 mm) between the bent-up parts 12S and lower sheet 15, and the cover sheet 11 has the left and right extension parts 11L, 11R (standard: 15 mm) which extend sideward from the both sides thereof, and further, the shape-retention upper sheet 12 is bonded to the flat face of the upper layer 1A with face bonding by the flat face width W1, thereby forming the heat shielding member 1.

The length of extension of the left and right extension parts 11L, 11R of the cover sheet 11 may be sufficient to cover heat shielding member body 10 so as not to produce a spacing between the left and right extension parts 11L, 11R and the side faces of the timbers (rafters).

Second Embodiment

Figure 5A:
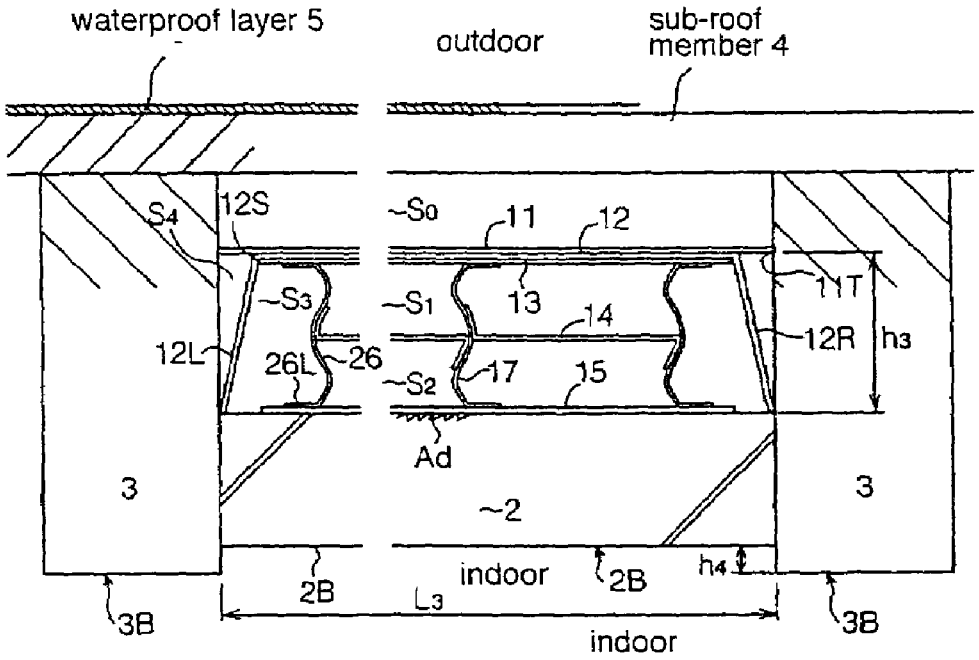
Figure 5B:
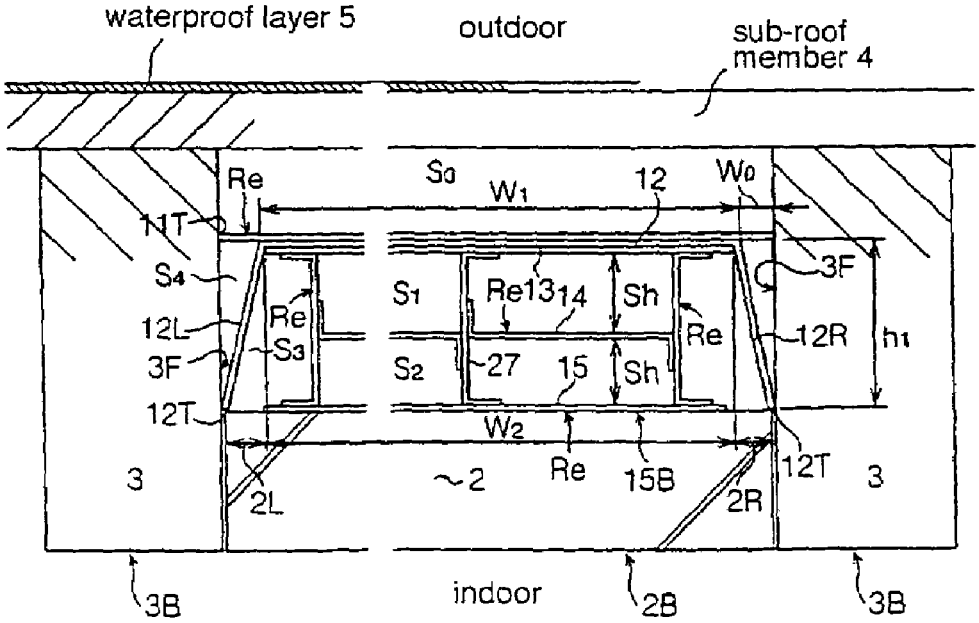

Type Having the Lower Sheet 15 and the Upper Sheet 13 Each Having the Same Width [FIGS. 5(A) and 5(B)]

The type having the lower sheet 15 and the upper sheet 13 each having the same width according to the heat shielding member 1 of the triple-layer configuration to be engaged between the rafters 3 of the roof, as shown in FIGS. 5(A) and 5(B), is applied to a case where the lower sheet 15 is made up of the same paper as the lower sheet 15 of First Embodiment (FIG. 1) and a widthwise dimension is the same as the width W2 of the upper sheet 13, wherein the cover body (cover layer) 10' is the same but only the lower sheet 15 of the heat shielding member body 10 is shorter compared with the heat shielding member 1 of First Embodiment (FIG. 1), that is the extension parts 15L, 15R of the lower sheet 15 are omitted from the heat shielding member 1 of the triple-layer configuration of the first embodiment, which can be fabricated in the same manner as First Embodiment.

Third Embodiment

Figure 6A:
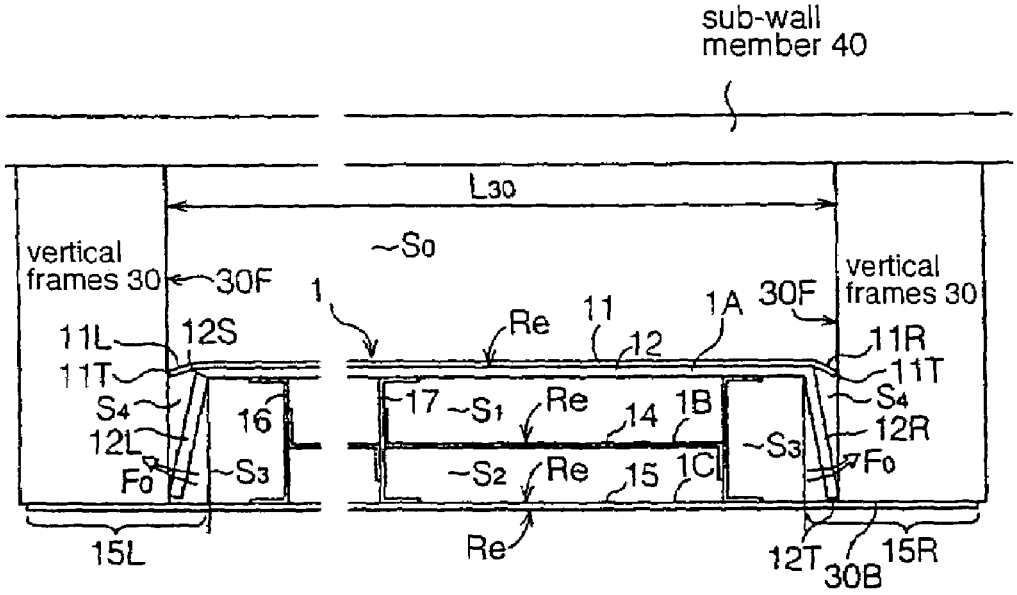
Figure 6B:
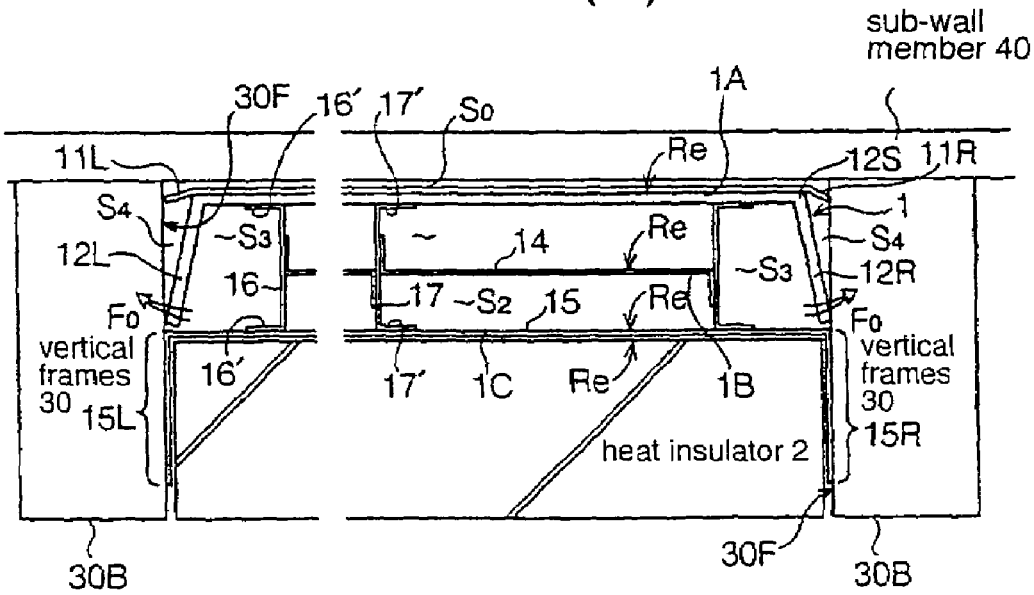

The Upper Layer 1A is Formed of Cover Layer 10' Alone [FIGS. 6(A) and 6(B)]

The heat shielding member 1 of a triple-layer configuration shown in FIGS. 6(A) and 6(B) is structured to omit the upper sheet 13 from the heat shielding member 1 of First Embodiment (FIG. 1).

When fabricating the heat shielding member 1, the cover layer 10' is prepared by laminating the cover sheet 11 to the shape-retention upper sheet 12 provided with the radiant heat reflective layer Re thereon, then subjecting the intermediate sheet 14, the lower sheet 15 and the stand-up pieces 16, 17 to a flow process comprising the steps of bending→providing an adhesive→press-bonding, then bonding the bent pieces 16', 17' of the stand-up pieces 16, 17 to the lower face of the shape-retention upper sheet (corrugated paper) 12 of the cover body 10' in a flat state where the bent-up legs 12L, 12R are not bent.

Figure 4A:
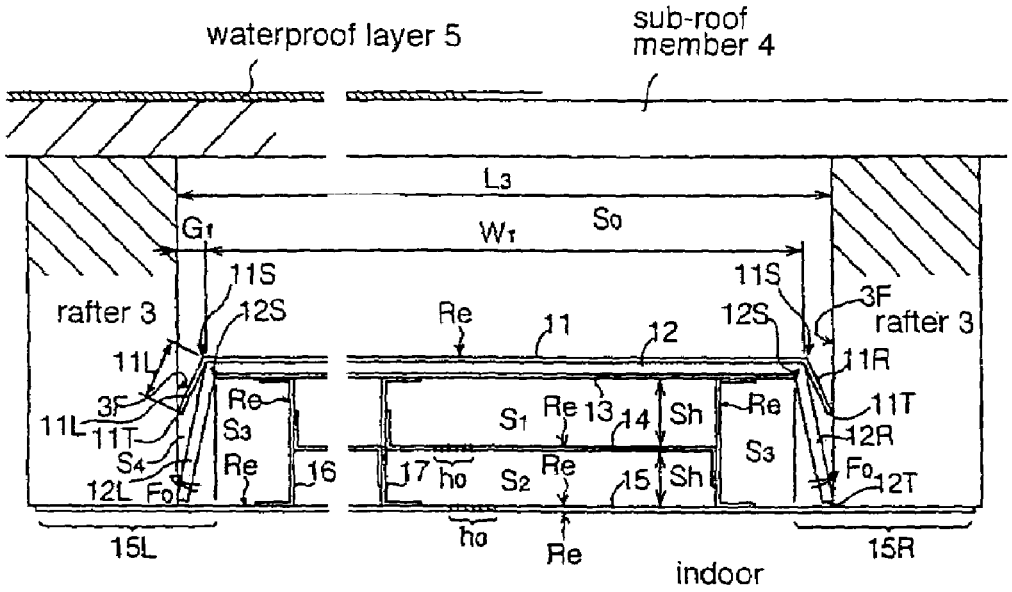
Figure 4B:
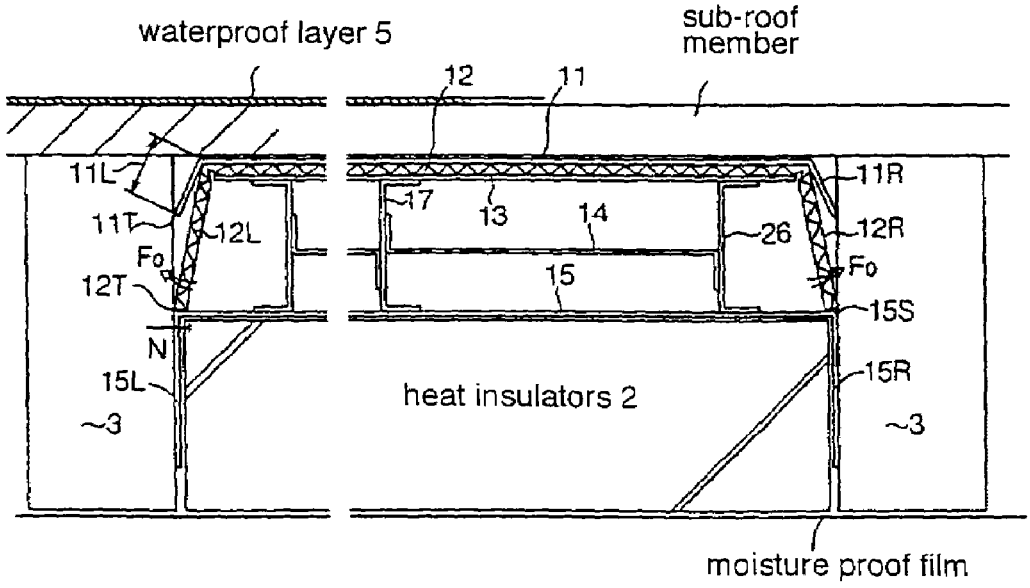

Use of the heat shielding member 1:

Application to a roof:

Use of the heat shielding member 1 of First Embodiment [FIGS. 4(A) and 4(B)]:

According to the heat shielding member 1 of First Embodiment (the lower sheet 15 is the type having the extension parts 15L, 15R) as shown in FIG. 4(A), the heat shielding member 1 having the bent-up legs 12L, 12R, at the creases of the bent-up parts 12S formed on the shape-retention upper sheet 12 of the upper layer 1A is engaged between the rafters 3 from the indoor side in a state where the flexible left and right extension parts 11L, 11R of the cover sheet 11 and the bent-up legs 12L, 12R are brought into contact with the side faces 3F of the rafters 3, thereafter pressed between the rafters 3 until the extension parts 15L, 15R are brought into contact with the bottom face 3B of the rafters 3, then the extension parts 15L, 15R at both ends of the heat shielding member 1 are brought into contact with and fixed to the single bottom face 3B of the rafters 3 in the manner that the extension parts 15L, 15R are superimposed on the single bottom face 3B, so that the thermal insulation structure of the roof can be formed by the heat shielding member 1 alone.

In this case, since the length of each of the bent-up legs 12L, 12R is substantially the same as the height h1 between the bent-up parts 12S and the lower sheet 15, the engagement and disposition of the heat shielding member 1 can be performed such that the bent-up legs 12L, 12R bear the press-in stress without any obstruction in operation to the spaces S1, S2 of the air layer.

Even if the dimensions of the extension parts 15L, 15R to be brought into contact with the bottom face 3B are not more than half the width of the bottom face 3B of the rafters 3, the extension parts 15L, 15R can be fixed to the rafters 3, but if the dimensions of the extension parts 15L, 15R are those to cover the width 3W of the bottom face 3B, the extension parts 15L, 15R can be fixed to the bottom face 3B in a stacked form so that the fixing portion becomes large, enhancing the fixing operation.

According to the thus obtained thermal insulation structure of the roof (FIG. 4(A)), the left and right extension parts 11L, 11R of the cover sheet 11 provided with the radiant heat reflective layer Re are bent owing to the flexibility to close the spacing G1 between themselves and the side faces 3F of the rafters 3, thereby suitably reflecting and discharging radiant heat in the space S0 of the air layer over the heat shielding member 1, and also small amount of air entered from the space S0 of the air layer under the cover sheet 11 is blocked in the space S4 of the air layer when the bent-up legs 12L, 12R are surely brought into contact with the side faces 3F of the rafters 3 owing to the restoring force F0, thereby preventing high temperature air over the upper layer 1A from entering the space S3 of the air layer.

It is possible to prevent heat of a high temperature air on the lower face of a sub-roof member from transferring downward under the lower sheet 15 (inward) by the radiant heat reflective layers Re of the respective layers.

Further, since the bent-up legs 12L, 12R have sufficient shape-retention property and restorability, the displacement and the tilting motion of the heat shielding member 1 can be completely prevented during the service life thereof, and the heat shielding member 1 fulfills a thermal insulation function at a value as designed as a thermal insulation structure which does not produce heat accumulation.

It is needless to say that the heat insulator 2 can be provided on the heat shielding member 1 of First Embodiment. In this case, as shown in FIG. 4(B), the extension parts 15L, 15R of the lower sheet 15 are bent, and the heat shielding member 1 is pressed in the rafters 3 until it reaches a given position, thereafter the bent extension parts 15L, 15R are fixed to the side faces 3F by nails, staples N and the like, then a solid heat insulator 2 or fibrous heat insulator 2 such as glass wool and the like is filled in a space defined by the bottom face 15B and the extension parts 15L, 15R. The heat insulator 2 is prevented from being slipped down by a conventional means, and a commonly used moisture-proof layer may be provided on the bottom face 2B of the heat insulator 2, if necessary.

Use of the heat shielding member 1 of Second Embodiment [FIGS. 5(A) and 5(B)]

FIGS. 5(A) and 5(B) show an example of use the heat shielding member 1 of Second Embodiment (the type having the lower sheet 15 and the upper sheet 13 each having the same width) having the cover sheet 11 a width of which is substantially the same as the interval L3 between the rafters 3, wherein the sub-roof member 4 is extended on the rafters 3 of a roof and a commonly used waterproof layer 5 is provided on the sub-roof member 4 to prevent rainwater from entering the sub-roof member 4 downward, then the heat insulator 2 having a predetermined thickness is bonded to the bottom face 15B of the lower sheet 15 by an adhesive Ad with the interval L3 between the rafters 3 after or simultaneously with the installation of a roof finishing member to integrate them, thereafter the heat shielding member 1, wherein creases are put to the bent-up parts 12S of the bent-up legs 12L, 12R, is pushed upward and engaged between the rafters 3 from the indoor side while the bent-up parts 12S conform to the end edges 13E of the upper sheet.

In this case, the bent-up legs 12L, 12R are operated owing to the restorability of the bent-up parts 12S at the creases thereof such that the tip ends 12T thereof are brought into contact with and engaged between the side faces 3F of the rafters 3 so that the cover sheet 11 closes the interval L3 between the rafters 3.

Then, the bent-up legs 12L, 12R are inclined due to the difference of dimensionW0 between the flat face width W1 of the upper layer 1A and the interval L3 between the rafters. In the course of pressing the heat shielding member 1 between the rafters 3, the bent-up legs 12L, 12R each has a height h3 which is slightly lower than the height h1 between the bent-up parts 12S and the lower sheet 15, and bear the press-in stress, and hence at the press-in completion position, both the stand-up pieces 16, 17 are slightly bent as shown in FIG. 5(A).

However, when the heat insulator 2 positioned as shown in FIGS. 5(A) and 5(B), is slightly pulled down to flush with the bottom face 3B of the rafters 3, the stand-up pieces 16, 17 properly stand up as shown in FIG. 5(B), whereby the tip ends 12T of the bent-up legs 12L, 12R of the shape-retention upper sheet 12 having shape retention property and restorability and made up of corrugated paper are brought into contact with the side faces 3F in a stretched state owing to the restoring force F0 depicted by arrows, thereby properly and stably holding the upper layer 1A, the intermediate layer 1B, the lower layer 1C of the heat shielding member 1.

It is needless to say that since the left and right extension parts 11L, 11R have flexibility and extend to the side faces 3F of the rafters 3, they close the interval L3 between the rafters 3 irrespective of the vertical position of the heat shielding member 1.

According to the thus obtained thermal insulation structure (FIG. 5(B)), there are stably secured the space S0 of the air layer between the cover sheet 11 of the upper layer 1A and the bottom face 4B of the sub-roof member 4, the space S1 of the air layer between the upper layer 1A and the intermediate layer 1B, the space S2 of the air layer between the intermediate layer 1B, the lower layer 1C and the space S3 of the air layer between the bent-up legs 12L, 12R and both the end stand-up pieces 16, and space S4 of the air layer between the left and right extension parts 11L, 11R of the cover sheet 11 and the bent-up legs 12L, 12R and radiant heat between respective layers can be discharged by the radiant heat reflective layers Re provided on each layer through the respective spaces S0, S1, S2, S3 of the air layer.

Accordingly, the transfer of a high temperature heating load transferred from the sub-roof member 4 toward the lower portion (inward) of the lower sheet 15 can be restrained so that the amount of heat accumulation in the heat insulator 2 disposed under the lower sheet 15 can be significantly reduced.

Since the bent-up legs 12L, 12R are brought into contact with the side faces 3F of the rafters 3 at the leg tips 12T owing to the restoring force F0, heat entering from the space S0 of the air layer which is rendered high in temperature toward the space S4 of the air layer under the cover sheet 11 are restrained from entering the space S3 of the air layer at both faces of both the end stand-up pieces 16 from the space S4 of the air layer, thereby restraining the heating load applied to the heat insulator 2 positioned under the heat shielding member 1.

In this case, since an outside air gently enters the respective spaces S0, S1, S2, S3, S4 of the air layer, the heat of air in each space of the air layer can be discharged outward by the radiant heat reflective layers Re of each layer, thereby restraining heat from transferring downward in each layer.

Although the slightly exposed portion of the heat insulator 2 at both sides of the lower sheet 15 contacts the air inside the space S3 of the air layer, since the air in the space S3 of the air layer is lower than the air in the space S0 of the air layer in temperature, a thermal obstruction is within an allowable range.

Application to the outer wall:

Use of the heat shielding member 1 of Third Embodiment [FIGS. 6(A) and 6(B)]:

FIGS. 6(A) and 6(B) are views showing the application of the heat shielding member 1 of Third Embodiment (the upper layer 1A is a type formed of the cover body 10' alone) to the thermal insulation of the outer wall.

That is, FIG. 6(A) is a view showing the thermal insulation structure of the outer wall formed by the heat shielding member 1 alone, wherein the upper face width W1 (FIG. 1) of the shape-retention upper sheet 12 to which the cover body 10' is laminated is slightly smaller (10 to 20 mm) than the interval L30 between the respective vertical frames 30 on which a sub-wall member 40 for an outer wall is stretched, while the shape-retention upper sheet 12 of the heat shielding member 1 has bent-up legs 12L, 12R to which creases are put at the bent-up parts 12S in advance, and the heat shielding member 1 engaged between the vertical frames 30 from the indoor side in a state while the left and right extension parts 11L, 11R of the cover sheet 11 are left to be wider than the interval L30 between the vertical frames, then the tip ends 11T of the left and right extension parts 11L, 11R of the cover sheet 11 and the tip ends 12T of the bent-up legs 12L, 12R are pressed toward the side faces 30F while slidably contact with the side faces 30F until the extension parts 15L, 15R are brought into contact with the bottom faces 30B of the vertical frames 30, and finally the extension parts 15L, 15R are brought into contact with the bottom faces 30B of the vertical frames 30 and fixed to the bottom faces 30B of the vertical frames 30 by an adhesive and the like.

The heat shielding member 1 forms the space S0 of the air layer between the sub-wall member 40 and the upper layer 1A when the tip ends 11T of the cover sheet 11 are bent toward and brought into contact with the side faces 30F, and the bent-up legs 12L, 12R form the space S4 of the air layer between themselves and the lower faces of the left and right extension parts 11L, 11R and the space S3 of the air layer between themselves and both the end stand-up pieces 16 when the tip ends 12T are brought into contact with the side faces of the vertical frames 30 in a stretched state owing to the restoring force F0 at the bent-up parts 12S of the corrugated paper, whereby the heat shielding member 1 is held in a proper posture by the bent-up legs 12L, 12R at both side of the shape-retention upper sheet 12 to keep the spaces S1, S2 of the air layer between respective layers, thereby forming the structure to prevent the communication between the spaces S0, S4 of the air layer and the space S3 of the air layer.

Further, FIG. 6(B) is an exemplified view showing a case where the heat shielding member 1 which is the same as shown in FIG. 6(A) is used integrally with the heat insulator 2, and also showing a manner of use of the heat shielding member 1 such that the heat shielding member 1 of Third Embodiment is used and the heat insulator 2 is bonded and fixed to the lower sheet 15 and engaged between the vertical frames 30.

The heat insulator 2 has a width dimension conforming to the interval L30 between the respective vertical frames 30, and the bent-up legs 12L, 12R of the shape-retention upper sheet 12 are bent along the creases at the bent-up parts 12S in advance, and also the extension parts 15L, 15R of the lower sheet 15 are bent toward the side faces of the heat insulator 2.

When the heat shielding member 1 is engaged and pressed between the vertical frames 30 while rendering the upper layer 1A to be directed as an outer face, the left and right extension parts 11L, 11R are bent and engaged between the vertical frames 30 while slidably contacting the side faces 30F and the extension parts 15L, 15R are also engaged between the vertical frames 30 while slidably contacting the side faces 30F, whereby at the fixed position of the heat shielding member 1, the tip ends 12T of the bent-up legs 12L, 12R are stretched against the side faces 30F to hold the heat shielding member 1 at a proper position, thereby forming the space S0 of the air layer having a small interval between the upper layer 1A and the sub-wall member 40, the space S4 of the air layer between the left and right extension parts 11L, 11R and the bent-up legs 12L, 12R and the space S3 of the air layer between the bent-up legs 12L, 12R and both the end stand-up pieces 16 so that the heat shielding member 1 can be held in a proper posture, thereby keeping the spaces S1, S2 of the air layer between the respective layers.

In this case, although air flow resistance is produced in the space S0 of the air layer of a small interval, air in the space S0 of the air layer is rendered high in temperature to create slight convection, and the cover sheet 11 thermally protects the heat shielding member 1 and the heat shielding member 1 prevents the transfer of radiant heat even in the intermediate layer 1B and lower layer 1C so that the heat shielding member 1 brings about the effect of restraining the heating load applied to the heat insulator 2 from the outdoor side, thereby significantly reducing the amount of heat accumulation.

It is needless to say that the heat shielding member 1 of First Embodiment (FIG. 1) can be applied to the thermal insulation of the outer wall like the heat shielding member 1 of Third Embodiment (FIGS. 6(A) and 6(B)).

According to the heat shielding member 1 of the preferred embodiments of the invention, since the constituent sheet members are all made of paper and excellent in a property of putting creases and adhesiveness, the fixation of the intermediate sheet 14 to the stand-up pieces 16, 17 and the fixation of the stand-up pieces 16, 17 to the lower sheet 15, the lamination of the cover sheet 11 to the shape-retention upper sheet 12, the fixation of the upper sheet 13 to the shape-retention upper sheet 12, and the like, which takes time in fabrication thereof, can be correctly and easily made in the flow process with the use of the group of rollers as the process of sheet members.

Further, since the stand-up pieces 16, 17 are bonded and fixed to the upper sheet 13 and the lower sheet 15 by use of the bent pieces 16' 17', the heat shielding member 1 can be stored while the stand-up pieces 16, 17 are in a laying down state (laminate state), so that the storage and transportation of the product are easily made.

Since the heat shielding member 1 is light because all the constituent sheet members are made of paper, and the heat shielding member 1 can be used by merely cutting the sheet of stacked form of a reduced bulk to a necessary length, putting creases at the flat bent-up parts 12S at both sides of the shape-retention upper sheet 12 in a flat state, and standing up the stand-up pieces 16, 17 in the case of installation and use of the heat shielding member 1 so that the transportation to a installation site, preparation of use and the installation of the heat shielding member 1 are respectively easily made.

The installation of the thermal insulation of the roof applied between the rafters 3 is performed after the sub-roof member 4 is extended while the installation of the thermal insulation of the outer wall applied between the vertical frames 30 is performed after the sub-wall member 40 is extended, and hence even in the case of the use of heat shielding member 1 alone or in the case of the use of the heat shielding member 1 integrally with the heat insulator 2, the installation of the heat shielding member 1 is performed from the indoor side, and the heat shielding member 1 can be installed even in a rainy day, and the period of time of installation of the thermal insulation can be shortened.

Further, since the installation of the thermal insulation of the roof is performed from the indoor side using a stepladder, it is not a dangerous operation at a high spot such as from the top of the roof as shown in FIGS. 7(A)–7(C) and 8(B) of the prior art, so that the insulating operation becomes safe with good workability.

Since the heat shielding member 1 is a light product and the bent-up legs 12L, 12R exert a stretching force relative to the side thereof and holds the heat shielding member 1 owing to the restorability at the bent-up parts 12S of the corrugated paper having large shape retention property to which creases are put, the position of the heat shielding member 1 can be temporarily held, and the fixing operation of the heat shielding member 1 is easily made by merely engaging the heat shielding member 1 between the rafters 3 or the vertical frames 30.

The heat shielding member 1 surely restrains the transfer of heat from the outdoor side toward the indoor side in a multistage manner because all the spaces S0, S1, S2, S3 and S4 of the air layer are disposed to ventilate air therethrough, and the radiant heat reflective layer Re on the cover sheet 11 of the upper layer 1A reflects the radiant heat from the outside and discharges it through the space S0 of the air layer, and the intermediate layer 1B and the lower layer 1C reflect and discharge the permeated and radiant heat through the spaces S1, S2 of the air layer, and also the radiant heat reflective layer Re on the outer faces of both the end stand-up pieces 16 reflect and discharge the radiant heat even through the space S3 of the air layer between both the end stand-up pieces 16 and the bent-up legs 12L, 12R.

Meanwhile, the Foundation for Building Material Test Center measured heat transfer resistance, heat transfer coefficient, and heat resistance, respectively of a unit of the heat shielding member 1 (triple-layered configuration, and the height h1 is 40 mm) of First Embodiment (FIGS. 4(A) and 4(B)) having the radiant heat reflective layers Re on the faces of the upper layer 1A, the intermediate layer 1B and the lower layer 1C, and confirmed that the heat shielding member 1 exhibits the heat transfer resistance (0.92 $m^2 \cdot k/w$) which is substantially the same as a glass wool mat having the same thickness as the heat shielding member 1. That is, the heat shielding member 1 fulfills heat shielding function even under non-insolation condition.

Since the heat shielding member 1 has the radiant heat reflective layers Re on the upper and lower faces of the lower sheet 15, in the case of a summer season and the like where the outdoor temperature is higher than the indoor temperature, the upper face of the lower sheet 15 reflects the radiant heat and discharges it through the space S2 of the air layer to mitigate the heating load applied to the indoor.

Further, in the case of a winter season and the like where the indoor temperature is maintained to be higher than the outdoor temperature, lower face of the lower sheet 15 reflects the radiant heat so that the indoor heat is restrained from being permeated and discharged toward the outdoor, thereby achieving an energy saving effect in indoor heating.

Further, since the intermediate sheet 14 and the lower sheet 15 have multiple pinholes ho to render the heat shielding member 1 moisture-permeable, it is possible to prevent dew condensation inside the heat shielding member 1, thereby restraining dew condensation on the radiant heat reflective layer Re and contamination caused by mold growth, so that durability of the heat shielding function is improved. When the heat insulator 2 is provided and used integrally with the heat shielding member 1, the lowering of the thermal insulation function caused by the absorption of moisture is also restrained.

According to the heat shielding member 1 of First Embodiment (the type wherein the lower sheet 15 has the extension parts 15L, 15R), in a state where in the same way so as the heat shielding member 1 of the type of Second Embodiment (FIGS. 5(A) and 5(B)), a solid heat insulator 2 such as foam molded plastic and the like having an appropriately prepared size is bonded and fixed to the bottom face 15B of the lower sheet 15 in advance, and the extension parts 15L, 15R of the lower sheet 15 are bent and brought into contact with the side faces of the heat insulator 2, the heat shielding member 1 is engaged and pressed between the timbers such as the rafters 3, the vertical frames of the wall, then the heat insulator 2 may be fixed to the timbers at both sides thereof by nails.

Also in this case, in the same manner when the heat shielding member 1 of Second Embodiment is used, the heat shielding member 1 enhances the thermal insulation function of the heat insulator 2 as an insulator having no accumulation property, and the heat insulator 2 significantly reduces the amount of heat accumulation owing to the thermal protection by the heat shielding member 1.

Further, the engagement and installation of the heat shielding member 1 can be applied to an interior of a section steel such as thin light section steel of an iron frame structure. The fixation of the lower sheet 15 to the steel material can be effected by a double-sided adhesive tape, a drilling tapping, screws and the like.

More still further, a bulk of thick paper or plastic sheet may be sufficient as the shape-retention upper sheet 12, if it can fulfill the function of the necessary restoring force F0 at the creases of the bent-up parts 12S. In the case of the plastic sheet, it is desirable to have moisture permeability by perforating it and the cover sheet 11 to form pinholes.

Further, the heat shielding member 1 of Second Embodiment (FIGS. 5(A) and 5(B)) can be applied to a thermal insulation of a ceiling of the prior art as shown in FIG. 8(A).

That is, the side faces of the heat shielding members 1 are mutually stretched against the face of the heat insulator which is provided on the ceiling finishing member by the leg tips 12T of the bent-up legs 12L, 12R owing to the restoring force F0 and the heat shielding members 1 are disposed in parallel with each other in the manner that the left and right extension parts 11L, 11R are mutually bent and brought into contact with each other to close the space on the upper face of an air layer, so that a small port for ventilation may be formed on the terminals of the heat shielding members 1 in the longitudinal direction.

Also in this case, the mutual heat shielding members 1 which are disposed in parallel with each other can be held in their positions by the mutual bent-up legs 12L, 12R, and the mutual cover sheets 11 cover the entire face of the insulator layer by the radiant heat reflective layers Re with no space between the cover sheets 11.

Since the heat shielding member 1 of the present invention can be engaged between the timbers such as the rafters 3 and the vertical frames and the like, to which the heat shielding member 1 is applied and mounted, from the upper layer 1A side, a safe and easy installation can be performed by using a stepladder and the like from the indoor side.

Accordingly, it is possible to perform installation in a state where the heat shielding member 1 does not get wet by rain after installation of the sub-roof member 4 and the sub-wall member 40, whereby the operation during a rainy day can be performed, thereby shortening a construction period, and the heat shielding member 1 which has been fixed to the rafters 3 and the like in a state where it does not get wet provides a durable thermal insulation structure in which neither mold growth nor rot caused by absorption of water occurs during the service life thereof.

Further, since the heat shielding member 1 is held in its position by the bent-up legs 12L, 12R having restorability which are stretched against the side surfaces of the timbers such as the rafters 3 and the like, the heat shielding member 1 is temporarily fixed when it is engaged between the timbers so that the fixing operation of the heat shielding member 1 to the timbers such as the rafters 3 is easily made, and hence the heat shielding member 1 can be held in a proper position with a proper posture by the bent-up legs 12L, 12R during the service life thereof after the installation thereof and it fulfills a heat shielding function at a value as designed.

Still further the thermal insulation structure obtained by the fixation of the heat shielding member 1 alone provides the thermal insulation structure which is easy in fixing operation without providing heat accumulation, while the thermal insulation structure to which the heat shielding member 1 is fixed so as to cover and protect the heat insulator 2 can render the thickness of the heat insulator 2 thin, and also the heat shielding member 1 controls to mitigate the heating load applied to the heat insulator 2 so that the amount of heat accumulation in the heat insulator 2 can be significantly restrained.

Still further, when the heat shielding member 1 is applied between the timbers such as the roof rafters and vertical frames of a wall, the cover sheet 11 having the radiant heat reflective layer Re on the face (outer face) hermetically covers between the timbers by the left and right extension parts 11L, 11R having flexibility, the bent-up legs 12L, 12R having shape-retention property are brought into contact with the side faces 3F (30F) with a restoring force F0 to hold the heat shielding member 1 at a proper position so that the left and right extension parts 11L, 11R and the bent-up legs 12L, 12R prevent a high temperature air over the upper layer 1A from entering the side faces (space S3 of the air layer) of the heat shielding member 1 in addition to the effect of the radiant heat reflective layers Re provided on the upper faces of the respective layers 1A, 1B, 1C of the heat shielding member and the outer side faces of both the end stand-up pieces 16, so that the heat shielding member 1 can preferably restrain the transfer of the heat from the outdoor side to the indoor side.

Further, since the pinholes ho are dispersedly disposed on the intermediate sheet 14 and the lower sheet 15 of the heat shielding member 1, dew condensation inside the heat shielding member 1 can be prevented and contamination of the radiant heat reflective layer Re caused by dew condensation and mold growth can be prevented, thereby restraining the lowering of the radiant heat reflecting function.

When the heat shielding member 1 is integrally used with the heat insulator 2, it is possible to restrain the lowering of the thermal insulation function caused by absorption by the heat insulator 2.

More still further, since the radiant heat reflective layers Re are provided on both sides of the lower sheet of the heat shielding member 1, the heat shielding member not only restrains the transfer of a high temperature heat in a summer season from the outdoor side to the indoor side, thereby reducing the cooling energy in the room but also restrains the transfer of the heat of the indoor heating in a winter season from the heat shielding member to the outdoor side, thereby reducing the heating energy in the room so that energy saving housing can be provided.

Further, since the extension parts 15L, 15R are formed on the lower sheet 15 of the heat shielding member 1 at both sides as fixtures, the thermal insulation structure can be formed by the heat shielding member alone by merely engaging the heat shielding member 1 between the timbers (rafters, vertical frames) and fixing to the lower surfaces of the timbers by the extension parts 15L, 15R, while if the extension parts 15L, 15R are bent toward the side faces of the heat insulator 2 and engaged between the timbers together with the heat shielding member 1, so that the thermal insulation structure wherein the heat insulator 2 is covered with the heat shielding member 1 can be formed, thereby making it possible to apply an appropriate thermal insulation structure to housing at appropriate spots, and also making it possible to provide housing having a reasonable thermal insulation structure.

What is claimed is:

1. A heat shielding member of a house comprising a plurality of layers comprised of an upper layer including at least a shape-retention upper sheet having a cover sheet laminated to the upper face thereof and a lower layer made up of a lower sheet;

spaces of an air layer formed between respective layers which are coupled by a group of stand-up pieces, wherein the stand-up pieces are positioned at both ends of the group of stand-up pieces and the group of stand-up pieces are positioned between the group of stand-up pieces, and have an opening enabling ventilation in the longitudinal direction; and radiant heat reflective layers provided on respective upper faces of the layers;

said shape-retention upper sheet having bent-up legs at both sides having restorability at bent-up parts.

2. The heat shielding member of a house according to claim 1, wherein the cover sheet has left and right extension parts at both sides thereof extending from points of the upper face of the bent-up parts of the shape-retention upper sheet.

3. The heat shielding member of a house according to claim 1, wherein the plurality of layers are a triple-layer having one intermediate layer formed of an intermediate sheet.

4. The heat shielding member of a house according to claim 1, wherein the upper layer comprises an upper sheet, the shape-retention upper sheet laminated to the upper sheet, and a cover sheet laminated to the shape-retention upper sheet and the group of stand-up pieces are coupled and fixed to the lower sheet and the upper sheet to be freely laid down.

5. The heat shielding member of a house according to claim 4, wherein both end edges of the upper sheet define bent-up parts of the bent-up legs of the shape-retention upper sheet.

6. The heat shielding member of a house according to claim 1, wherein the upper layer is made up of the cover sheet and the shape-retention upper sheet, and the group of the stand-up pieces are fixed between the lower sheet and the shape-retention upper sheet to be freely laid down.

7. The heat shielding member of a house according to claim 1, wherein the lower sheet has extension parts at both sides thereof.

8. The heat shielding member of a house according to claim 1, wherein the shape-retention upper sheet defines a flat face width of the upper layer between the bent-up parts at both sides and has the bent-up legs having substantially the same dimensions as a height between the bent-up parts and the lower sheet.

9. The heat shielding member of a house according to claim 1, wherein outer faces of both the end stand-up pieces provided at both ends and a bottom face of the lower sheet are provided with radiant heat reflective layer, and pin holes are dispersely disposed on entire faces of the intermediate sheet and the lower sheet constituting the intermediate layer, respectively.

10. The heat shielding member of a house according to claim 1, wherein the shape-retention upper sheet is made up of corrugated paper, and other sheets and the stand-up pieces are made up of kraft paper, and the radiant heat reflective layer is an aluminium foil stuck layer.

* * * * *